United States Patent [19]

Lambert

[11] 4,212,450

[45] Jul. 15, 1980

[54] JACKING APPARATUS

[75] Inventor: R. Bruce Lambert, Chatsworth, Calif.

[73] Assignee: Santa Fe International Corporation, Orange, Calif.

[21] Appl. No.: 937,030

[22] Filed: Aug. 25, 1978

[51] Int. Cl.[3] ..... B66F 1/04

[52] U.S. Cl. ..... 254/108; 254/105

[58] Field of Search ..... 254/108–111, 254/105

[56] References Cited

U.S. PATENT DOCUMENTS

| | | | |
|---|---|---|---|
| 3,031,167 | 4/1962 | Ronssel | 254/105 |
| 3,821,934 | 7/1974 | Maeda | 254/105 |
| 4,007,915 | 2/1977 | Chambers | 254/108 |

FOREIGN PATENT DOCUMENTS

| | | | |
|---|---|---|---|
| 242233 | 1/1964 | Netherlands | 254/108 |

*Primary Examiner*—Robert C. Watson

*Attorney, Agent, or Firm*—Michael P. Breston

[57] ABSTRACT

The jacking apparatus comprises a load frame adapted to move relative to a rail having single slots longitudinally spaced therealong. A pawl carriage is disposed inside the frame for movement relative thereto. A single, double-acting hydraulic actuator is coupled between the frame and the carriage. A pawl member is vertically supported by the carriage for pivotal movement between two diametrically-opposite positions. The pawl member has a claw foot shaped so as to fall into successive slots. The claw withdraws from a rail slot and permits linear motion of the carriage over a distance equal to the actuator stroke, near the end of which the claw falls into the next slot. The claw will then permit linear motion of the load frame during the opposite stroke of the actuator. The reciprocating strokes of the hydraulic actuator produce alternate incremental movements of the load frame and of the carriage.

7 Claims, 14 Drawing Figures

DT
14
15
17
43
5
35
36
49
32
34
30
51
52
33
39
55
31

Fa
Fb
43
35
49
6
32
17
25'
34
51
53
52
33
39
R
57
55
56
17'
54
P
58
31
15
16
14

39
32
15
35
25'
17
16
12
36
49
30
14

14
17
51
52
55
59
58
R
D
T
56
15

JACKING APPARATUS

BACKGROUND OF THE INVENTION (a) Field of the Invention

This invention relates to a jacking apparatus for moving loads along a rail mounted on a horizontal base, such as on the deck of a floating platform.

(b) The Prior Art

Prior art jacking devices for moving heavy loads along a rail generally comprised sleds with large hydraulic cylinders connected to claws which successively engaged holes in a rail, see for example, U.S. Pat. No. 4,007,915 and the references cited therein.

The main drawbacks of such known devices are due to the fact that: they are massive and of relatively inflexible design, they require many accurately machined and located rail slots, they lack flexibility in operation, for example, their direction of motion is not easily reversible, and they require relatively complex auxiliary equipments to assist in their operation.

Moreover, in those jacking devices which must employ pairs of laterally-spaced hydraulic cylinders, when one cylinder of the pair becomes inoperative, or when the forces produced by the individual cylinders become unbalanced, either such jacking devices become inoperative or they lose some of their effectiveness.

Accordingly, the main objects of the present invention are to simplify the construction and cost of such known jacking devices, and to employ only single slots longitudinally spaced along the rail. The slots need not be accurately spaced apart. It is a further object to provide jacking devices which are easy to assemble and to dis-assemble, which occupy a minimum of space, which require a minimum of material, thereby making them relatively lightweight, which require no pairs of balanced cylinders, which require a minimum of joining operations during their construction, and which require simple means for changing the direction of motion of the jacking device. Other objects will become apparent from the specification when considered together with the drawings.

SUMMARY OF THE INVENTION

The jacking apparatus of the present invention comprises a load frame adapted to move over a rail having longitudinally-spaced single slots. A carriage is movably positioned inside the frame. A single, reciprocating, double-acting hydraulic actuator is coupled between the frame and the carriage for causing relative movements therebetween. A pawl member is supported by the carriage for pivotal movement about a transverse pivot axis between two diametrically-opposite positions. The pawl has a claw foot with two claws symmetrically disposed relative to a plane containing the pivot axis and the longitudinal axis of the pawl. Each claw is shaped so as to fall into successive rail slots and to permit incremental motion of the pawl carriage only during one stroke of the hydraulic actuator, and conversely, during the reverse stroke of the hydraulic actuator, to permit incremental motion of the load frame only and of any load moved therewith. The direction of motion of the load frame is determined by the position of the claw foot relative to the pivot axis of the pawl member. The hydraulic actuators can be easily arranged in tandem for extra heavy loads.

DETAILED DESCRIPTION OF PREFERRED EMBODIMENTS

Figure 1:
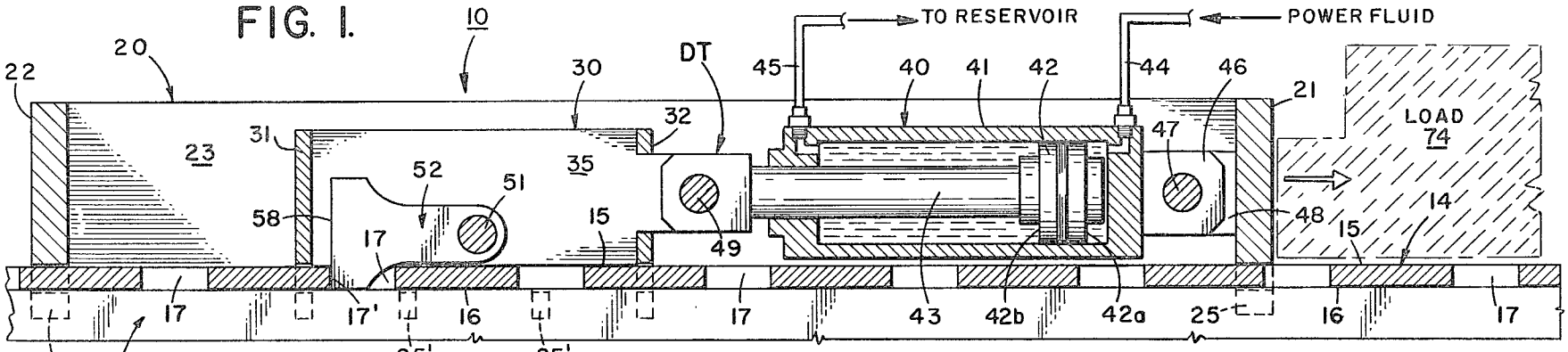
FIG. 1 shows a side view, partly in section, of a preferred embodiment of the jacking apparatus of the invention in condition for the start of the incremental movement of the load frame.

The jacking apparatus of this invention, generally designated as 10 (FIGS. 1–9), is adapted for moving a load 74 over a rail 12 which is of suitable length, and which can be mounted on any suitable supporting base 9, such as ground, a warehouse surface, a barge deck, etc. Rail 12 has a flange 14 (FIG. 6) having top and bottom surfaces 15, 16, respectively. A plurality of substantially identical slots 17, preferably rectangular in shape, are cut through the flange 14 and are longitudinally spaced therealong.

The jacking apparatus 10 comprises a load frame or sled 20 adapted to slide over the top surface 15 of flange 14. Sled 20 can be constructed in any desired manner, and for simplicity it is illustrated as having a box shape with transverse walls 21, 22 and longitudinal walls 23, 24. The transverse walls 21, 22 have turned-under brackets 25 (FIG. 9) which extend underneath the bottom surface 16 of flange 14. Brackets 25 thus capture the side edge portions of flange 14 thereby preventing rotation of sled 20 about rail 12.

Load frame 20 houses a drive train DT comprising a pawl carriage, generally designated as 30, which is also slidably mounted on top surface 15 of flange 14, and a hydraulic actuator 40. Carriage 30 can assume various configurations. For simplicity it is shown (FIGS. 4–6) as having a box-like shape formed by two longitudinally-spaced end plates 31, 32, a pair of longitudinally-spaced intermediate plates 33, 34, a pair of transversely-spaced support plates 35, 36, and a pair of transversely-spaced top plates 39. Longitudinally spaced plates 31–34 have turned-under brackets 25' (FIG. 6) similar to brackets 25 (FIG. 9) of the load frame plates and for the same purpose. Support plates 35, 36 extend outwardly of the carriage through openings in end plate 32.

Figure 4:
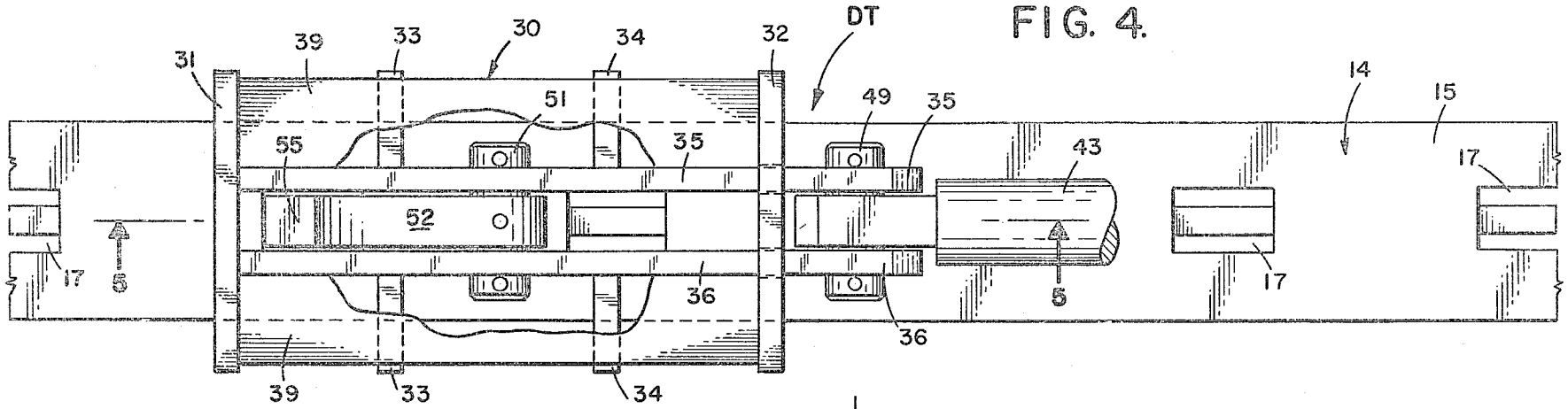
FIG. 4 is a top view of the carriage in the jacking apparatus shown in FIG. 1.

Hydraulic actuator 40 has a housing 41, a double-acting piston 42, and a piston rod 43. A pair of fluid inlets alternately admit pressurized fluid to the opposite faces of piston 42, and such inlets are coupled to fluid lines 44, 45. Housing 41 has a tongue 46, which is pivotably coupled by a pivot 47 to a projection 48 of end plate 21. Piston rod 43 is also pivotably coupled by a pivot 49, which is supported on the outer projections of side plates 35, 36 (FIG. 4).

Figure 5:
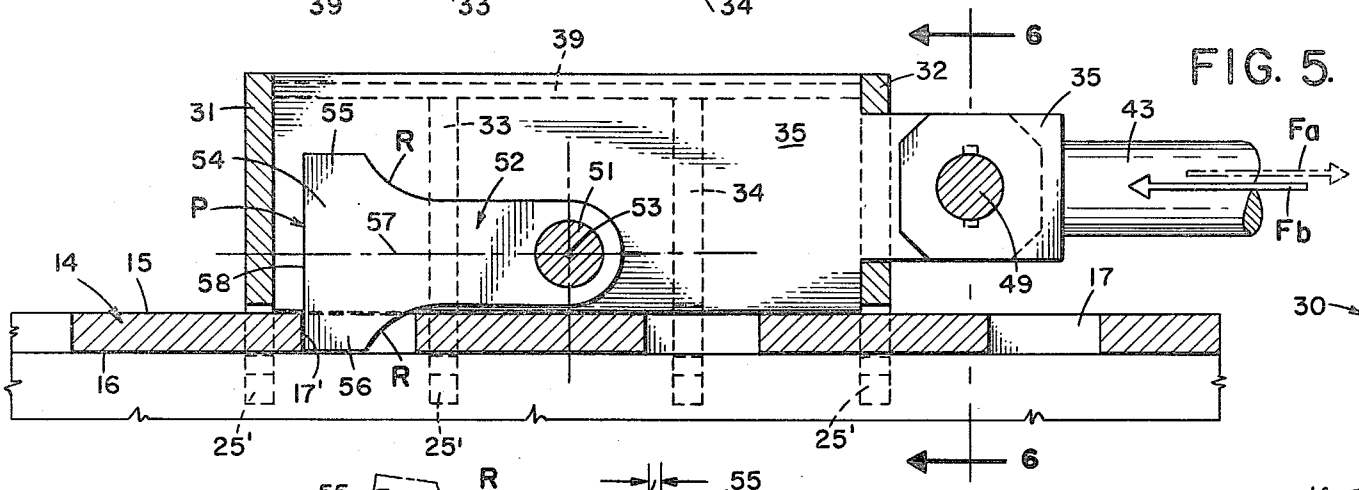
FIG. 5 is a partly sectional view on line 5—5 in FIG. 4.
Figure 6:
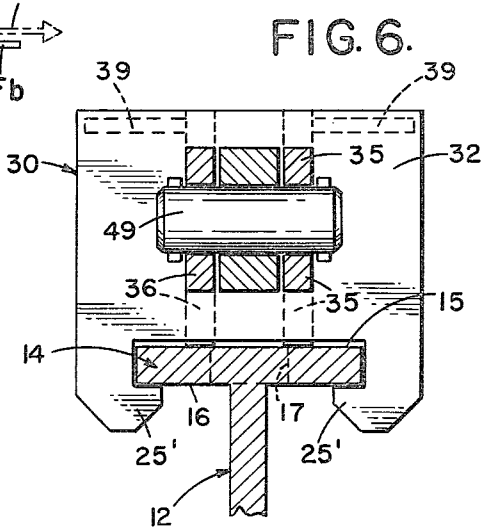
FIG. 6 is a sectional view on line 6—6 in FIG. 5.
Figure 7:
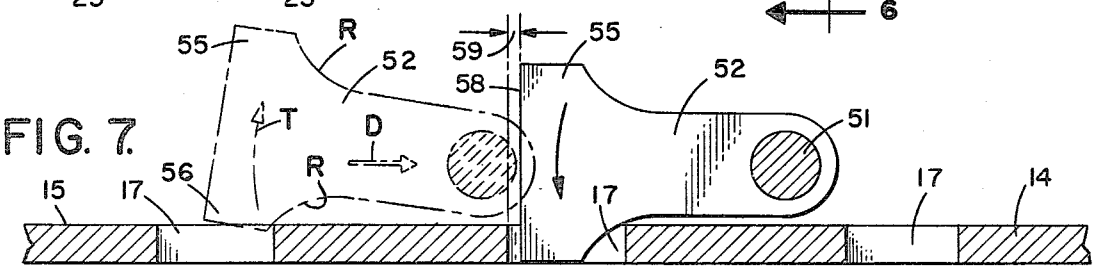
FIG. 7 illustrates the unlatching of the claw foot from a rail slot and its subsequent latching with the next slot.
Figure 8:
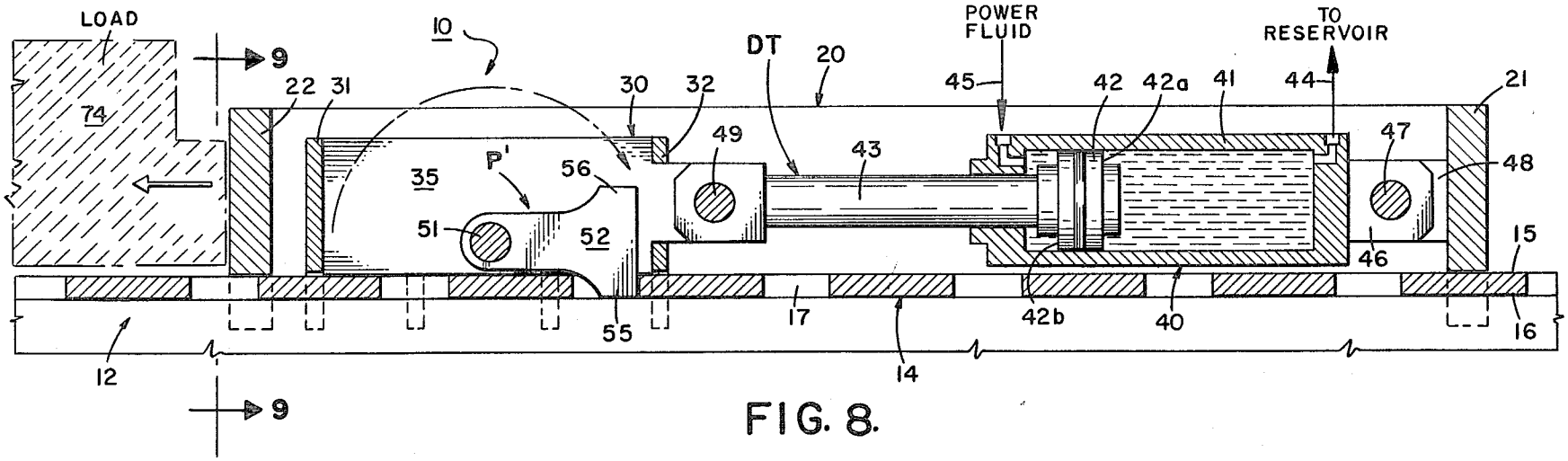
FIG. 8 is a view similar to FIG. 1, but with the pawl member in its diametrically-opposite position for changing the direction of motion of the load frame.

Pivotably mounted on a pivot 51 is a vertical pawl member, generally designated as 52, which pivots about a transverse pivot axis 53 between two diametrically-opposite positions P and P' (FIGS. 5 and 8). Pawl member 52 carries out a ratcheting action in conjunction with flange 14. Pawl member 52 has a claw foot 54 provided with two vertically-extending claws 55, 56 which are symmetrically disposed relative to (1) a plane containing pivot axis 53 and to (2) the longitudinal axis 57 of the pawl member 52. The claw foot 54 has a flat outer end face 58 which is normally spaced from the side edge of a rail slot by an over-travel distance 59 (FIG. 7) for allowing the claw foot 54 to drop into a slot 17.

When the pawl member becomes subjected to a force Fb (FIG. 5), then end face 58 will engage the side edge 17' of the rail slot 17. To allow each claw 55 or 56 to slide over the side edge 17', it is provided with an inner slanted or arcuate side face R of a suitable slope or radius, so that pawl 52 can rotate about an arc T when pulled in a direction D (FIG. 7) by piston rod 43. Thus the slanted or arcuate face R permits each claw to unlatch itself from its captivating rail slot 17. The spacings between slots 17 correspond to the length of the working stroke of the piston rod 43.

Figure 10:
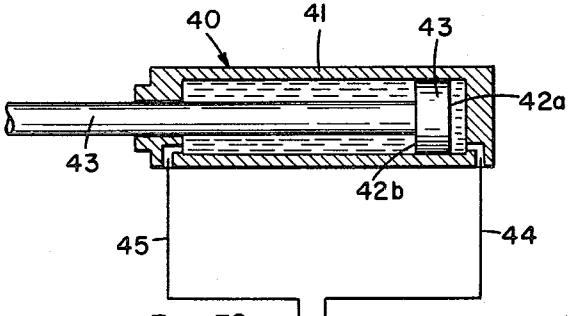
FIG. 10 is a schematic representation of a simple hydraulic circuit for driving the double-acting piston in the hydraulic cylinder.
Figure 10:
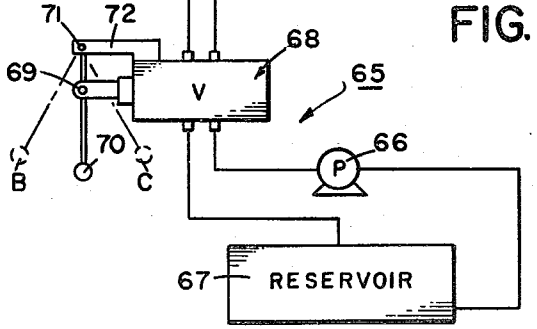
Figure 9:
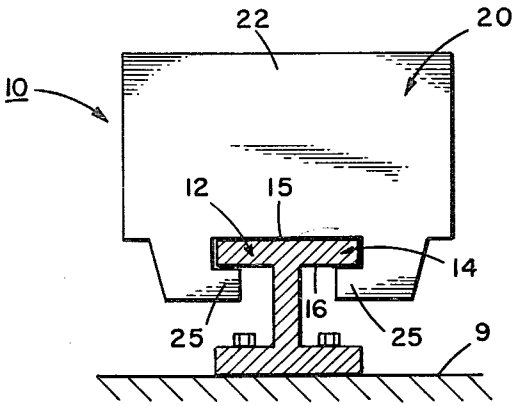
FIG. 9 is an end view, on line 9—9 in FIG. 8, showing the turned-under edges of the load frame.

A simplified hydraulic circuit, generally designated as 65, is shown in FIG. 10 for causing alternate retractions and extensions of piston rod 43, and includes a hydraulic pump 66 connected between a fluid reservoir 67 and a valve 68. The valve's spool is pivotably connected by a pivot 69 with a handle 70, which can assume two extreme positions B or C (shown by dotted lines) and a neutral position therebetween (shown by solid lines). The outer end of handle 70 is pivoted about a pivot 71 supported by a bracket 72 extending from the valve's housing.

When handle 70 is in position B, pressurized fluid will flow into line 44 to exert a pressure on the outer face 42*a* of piston 42. The fluid from the hydraulic cylinder will return through line 45 to reservoir 67. Conversely, when handle 70 is in position C, pressurized fluid will be applied through line 45 to exert pressure on the inner face 42*b* of piston 42, and the cylinder's fluid will return through line 44 to reservoir 67. Since the surface area of face 42*a* is larger than that of face 42*b* by an amount equal to the cross-sectional area of the piston rod 43, the axial forces exerted by the piston rod 43 are not equal in its forward and reverse strokes.

Figure 11:
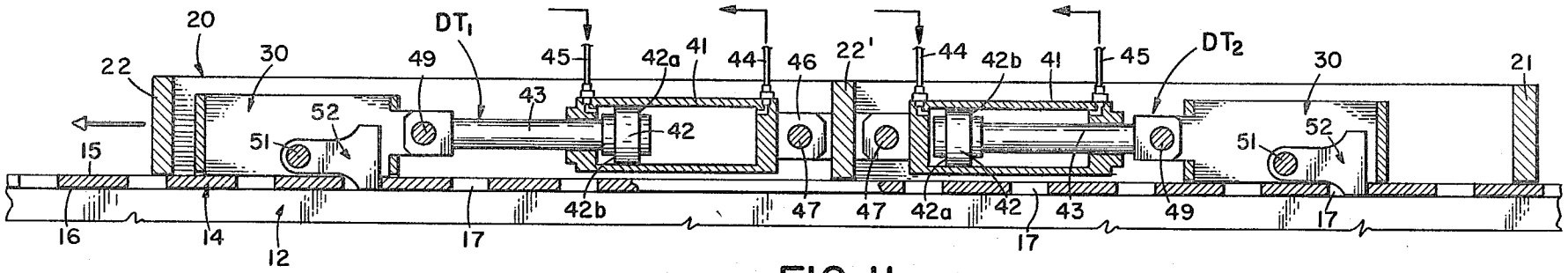
FIG. 11 shows a tandem arrangement of two drive trains to provide equal power in both directions of load frame movement.
Figure 12:
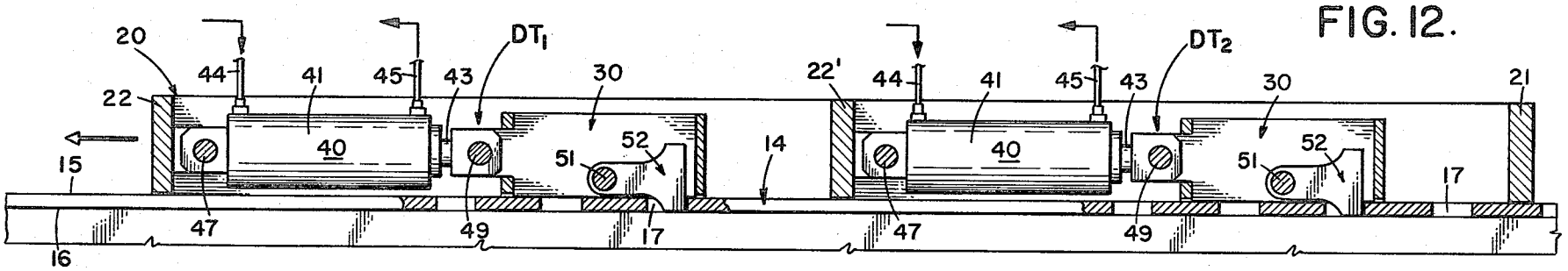
FIG. 12 shows an alternate arrangement of the drive trains.
Figure 13A:
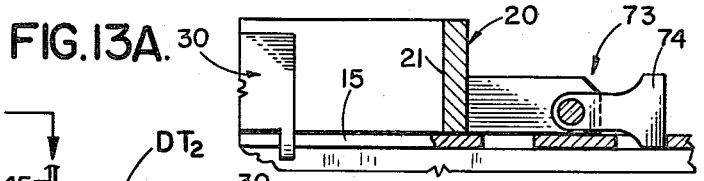
FIG. 13A is a partial side view of the arrangement shown in FIG. 12.
Figure 13:
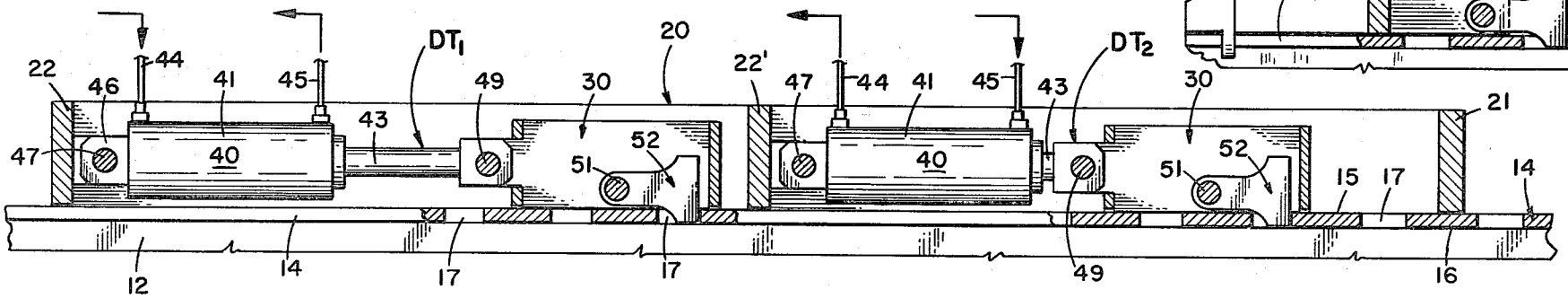
FIG. 13 shows an alternate mode of operation of the drive trains in FIG. 12.

With reference now to FIGS. 11–13, there are shown arrangements of a pair of drive trains DT1 and DT2. In FIG. 11 the drive trains are pivotably coupled to the opposite sides of a center partition wall 22'. In FIGS. 12 and 13 only the second drive train DT2 is connected to the center wall 22'.

In operation of the jacking apparatus of the present invention, load frame 20 is placed on rail 12 for moving a load 74, for example, an off-shore structure (not shown) which is to be loaded on or unloaded from the deck of a floating platform.

Figure 2:
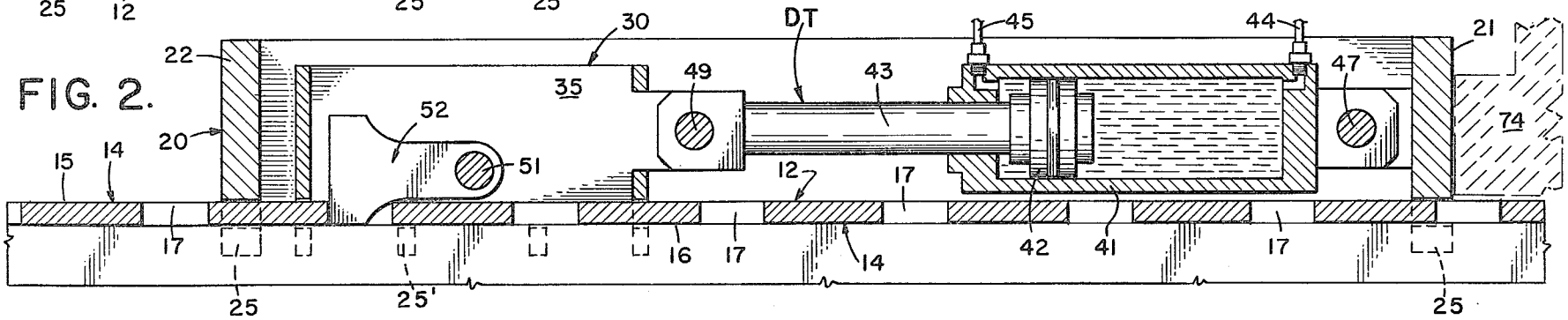
FIG. 2 shows the load frame at the end of its incremental movement.
Figure 3:
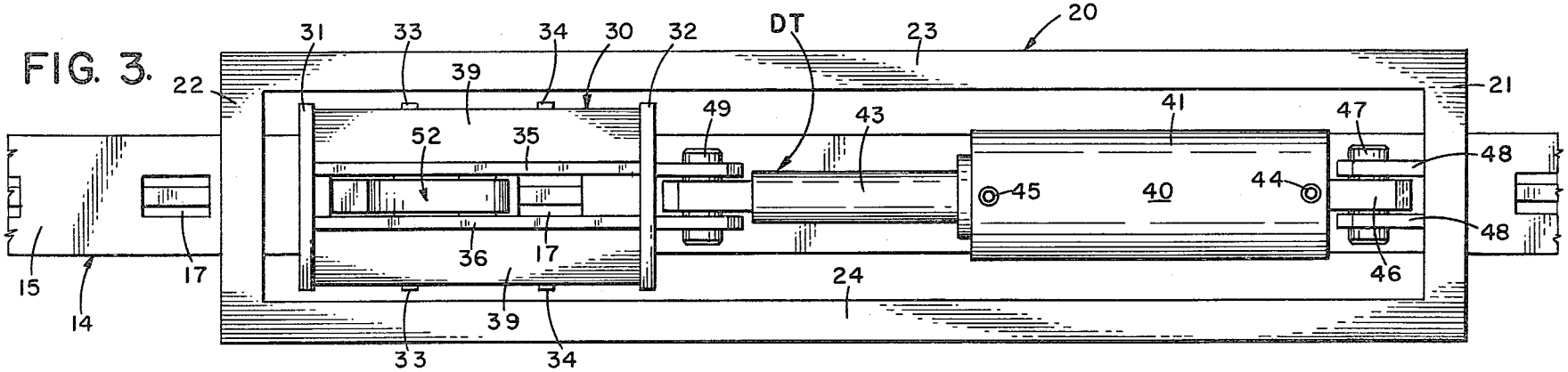
FIG. 3 is a top view of the jacking apparatus shown in FIG. 2.

For the arrangement shown in FIG. 1, when handle 70 is moved to its position C (FIG. 10), the hydraulic circuit will provide high fluid pressure into line 44 against face 42*a* of piston 42, and fluid from the hydraulic actuator 40 will drain through line 45 to reservoir 67. Piston 42 then moves rod 43 to the left, as viewed in FIG. 1, which is the forward stroke for piston 42. The force Fb (FIG. 5) developed by the rod is transferred to the pawl member 52, causing its end surface 58 to engage side edge 17' of its captivating rail slot 17, thereby preventing movement of pawl carriage 30. As a result, housing 41 of actuator 40 moves to the right, in the direction of the arrow, until rod 43 reaches the end of its stroke (FIG. 2). Handle 70 (FIG. 10) is then shifted to its neutral A position. Thus the load frame 20 has advanced by a distance corresponding to the length of the piston rod stroke.

When handle 70 is shifted to its other opposite position B, high pressure fluid is supplied into line 45 and fluid from actuator 40 returns through line 44 to reservoir 67. The pressurized hydraulic fluid exerts a force on the piston's face 42*b* causing its rod 43 to start on its return stroke. Rod 43 exerts a force Fa (FIG. 5) on pawl member 52, thereby rotating the claw foot 54 along arc T. Claw foot 56 lifts out of its rail slot, and pawl member 52 moves in the horizontal direction D.

As the piston rod continues to execute its reverse stroke, pawl member 52 continues to slide on the top surface 15 of rail flange 14 until it falls into the next adjacent rail slot coinciding with the end of the reverse stroke. This completes a full cycle of operation of the drive train DT.

With reference to FIG. 13A, load retaining pawl assembly 73 can be provided to prevent the load frame 20 from moving back along the rail 12, as the piston rod executes its reverse stroke. In this assembly, a secondary pawl member 74, which may be identical in all respects to pawl member 52, is mounted on a pivot rigidly connected to one end of the load frame 20, and is pivotable about a transverse pivot axis between two diametrically-opposite positions. Pawl member 74 carries out a ratcheting action in conjunction with flange 14, such that, as the load frame is pushed forward in the direction of travel, the claw foot of the pawl 74 unlatches itself from one rail slot and drops into the next rail slot, in the manner described previously for pawl member 52. However, when the piston rod executes its reverse stroke, pawl member 74 prevents reverse movement of the load frame.

Obviously, the hydraulic circuit 65 can be modified to avoid manual operation; that is, so that the drive train DT automatically executes a predetermined number of complete cycles of operation. For each half-cycle, the load frame 20 will move depending on the position of pawl member 52.

To change the direction of motion, pawl member 52 is rotated (by any suitable means not shown) about pivot axis 53 from its position P (FIG. 8) to its diametrically-opposite, alternate position P'. Whereas pressurized fluid admitted into line 45 in the arrangement of the drive train, shown in FIG. 2, causes the advancement of the pawl carriage to the right, pressurized fluid admitted into line 45 in the arrangement of the drive train, shown FIG. 8, causes load from 20 to advance to the left. Thus, it will be appreciated that, in accordance with the invention, the direction of motion of the load frame can be easily controlled by simply rotating the pawl member 52 on or about pivot 51 between positions P and P'.

To move extremely heavy loads or to make the pushing force equal to the pulling force, two or more drive trains can be connected in tandem as shown in FIGS. 11–13. With the drive trains connected as shown in FIG. 11, when high pressure fluid is admitted into lines 44, 45 of drive trains $DT_2$, $DT_1$, their pawl members 52 will latch onto their captivating rail slots 17, causing load frame 20 to move to the left (as viewed in FIG. 11).

When pressurized fluid is admitted into lines 45, 44 in drive trains $DT_2$, $DT_1$, respectively, their pawl carriages will move to the left, thereby placing the load frame in condition to execute its next incremental movement.

With the embodiment shown in FIG. 11, when the load frame moves to the left it exerts a force which is proportional to the surface area of face **42*b* of piston 42 in the drive train $DT_1$ plus the surface area of face 42*a* of piston 42 in the drive train $DT_2$. When the load frame 20** moves to the right it will exert the same force as when it moves to the left.

When pressurized fluid is applied into lines 44 of drive trains $DT_1$, $DT_2$, the pawl members will latch themselves against their captivating rail slots, thereby causing the load frame to move to the left, as viewed in FIG. 12. It will be apparent that with the arrangement of the drive trains shown in FIG. 12, the load frame will push or pull with a greater force when moving to the left then when moving to the right.

In the embodiment of FIG. 13 which is structurally identical to the embodiment shown in FIG. 12, pressurized fluid is admitted into line 44 of the drive train $DT_1$, and pressurized fluid is simultaneously admitted into line 45 of the drive train $DT_2$. In the drive train $DT_1$ the pawl carriage is locked, causing its hydraulic cylinder to move the load frame 20, while in the drive train $DT_2$ the pawl carriage is made to move to its next slot in the direction of the arrow. Conversely, during the next half cycle of operation, the flow in the fluid lines is reversed causing the drive train $DT_2$ to provide the propulsion to the load frame 20.

It will be appreciated that in accordance with the invention, the location of the vertical slots 17 is not critical as compared to the requirements imposed by known prior art jacking units. Since only single cylinders are employed or a plurality of cylinders connected in series within each load frame, no side torques are created as was common with certain prior art jacking units employing pair of cylinders in parallel. Also by merely rotating the pawl member from one position to its alternate position, a reversal of direction of load frame motion is obtained. The rotation of the pawl members can be easily accomplished with relatively simple tools.

What is claimed is:

1. A jacking apparatus for moving a load over a rail having a plurality of longitudinally-spaced slots therealong, said apparatus comprising:

a load frame adapted to move over said rail for moving a load therewith, a carriage inside said frame adapted to move over said rail, a pawl member mounted on said carriage for rotation about a transverse pivot axis between two angular positions, a reciprocating, double-acting, hydraulic cylinder coupled between said carriage and said frame for producing relative movements therebetween, said pawl member having a claw foot adapted to mesh with the consecutive slots on said rail, said claw foot having a pair of outwardly extending side claws which are symmetrically disposed relative to a plane containing said pivot axis and the longitudinal axis of said pawl member, and said claw foot engaging said rail during one stroke of said cylinder, and becoming disengaged from said rail during the reverse stroke of said cylinder, depending on the angular position of said pawl member.

2. The jacking apparatus of claim 1, wherein each claw foot has a latching outer end surface for engaging the side wall of a rail slot and a curved inner surface for disengaging from said slot while pivoting about said pivot axis.

3. The jacking apparatus of claim 2, wherein said latching end surface is substantially flat.

4. The jacking apparatus of claim 3, wherein said end surface is spaced from the edge of the rail slot by an over-travel distance to allow each claw foot to drop into said rail slots.

5. The jacking apparatus of claim 1, wherein each claw has an inner arcuate side face of a predetermined radius to permit the claw to unlatch from said rail slots.

6. A jacking apparatus which is self-propelled over a rail having a plurality of longitudinally spaced slots, comprising:

a load frame slidably mounted over said rail, a carriage disposed inside said frame for movement relative thereto, a hydraulic cylinder unit having a double-acting piston, said unit being coupled between said frame and said carriage for incrementally moving the frame relative to the stationary carriage during one stroke of the piston, and for incrementally moving the carriage relative to the stationary frame during the reverse stroke of the piston, and a pawl member supported by said carriage for pivotal movement about a transverse pivot axis between diametrically-opposite positions, said pawl member having a pair of outwardly-extending claws symmetrically disposed relative to a plane containing said pivot axis and the longitudinal axis of said pawl; each claw being shaped to mesh with successive slots, and each claw having an outer latching face permitting said incremental motion of said load frame, and an inner curved face permitting said incremental motion of said carriage.

7. The jacking apparatus of claim 6, and, another pawl member, means supporting said another pawl member on one end of said load frame for pivotal movement about a transverse pivot axis between diametrically opposite positions, and, said another pawl member acting to restrain the load frame from movement relative to the rail during incremental movement of the carriage relative to said load frame.

* * * * *